United States Patent [19]

Gross et al.

[11] Patent Number: 5,058,775

[45] Date of Patent: Oct. 22, 1991

[54] TOGGLE-ACTING DISPENSING CLOSURE WITH PREMATURE ACTUATION PREVENTION MEANS

[75] Inventors: Richard A. Gross, Crystal Lake; Dieter F. Lay, Hawthorn Woods, both of Ill.

[73] Assignee: Seaquist Closures, a Division of Pittway Corporation, Crystal Lake, Ill.

[21] Appl. No.: 630,402

[22] Filed: Dec. 19, 1990

Related U.S. Application Data

[63] Continuation of Ser. No. 345,998, May 2, 1989, abandoned.

[51] Int. Cl.[5] ..... B67B 5/00

[52] U.S. Cl. ..... 222/153; 222/531; 215/235; 215/254

[58] Field of Search ..... 222/153, 531, 532, 402.11, 222/541, 556; 215/213, 221, 235-237, 254, 250, 251; 220/265, 336, 254, 259, 282, 283

[56] References Cited

U.S. PATENT DOCUMENTS

| | | | |
|---|---|---|---|
| 3,480,184 | 11/1969 | Landis | 222/153 |
| 3,744,682 | 7/1973 | Blank | 222/402.11 |
| 4,067,482 | 1/1978 | Vogel et al. | 222/402.11 |
| 4,081,108 | 3/1978 | Wilson et al. . | |
| 4,142,650 | 3/1979 | Almouli | 222/402.11 |
| 4,595,123 | 6/1986 | Libit | 220/259 |
| 4,711,380 | 12/1987 | Ulm . | |
| 4,736,858 | 4/1988 | Shastal | 215/236 |
| 4,776,501 | 10/1988 | Ostrowsky | 222/556 |

FOREIGN PATENT DOCUMENTS

| | | | |
|---|---|---|---|
| 0111813 | 6/1984 | European Pat. Off. . | |
| 1333334 | 10/1973 | United Kingdom | 222/153 |
| 2209155 | 5/1989 | United Kingdom . | |

*Primary Examiner*—H. Grant Skaggs

*Attorney, Agent, or Firm*—Dressler, Goldsmith, Shore, Sutker & Milnamow, Ltd.

[57] ABSTRACT

A toggle-acting dispensing closure which is resistant to premature actuation of said actuator during shipping and handling prior to purchase, and which provides evidence that access has been gained to the contents of the associated container. A removable tear tab means is provided on the closure actuator or on the body of the closure which interferes initially with the pivoting of the actuator on the body. The tear tab means is frangibly connected to the actuator or body and is positioned between the body and actuator adjacent the actuator finger pad.

7 Claims, 1 Drawing Sheet

FIG. 1
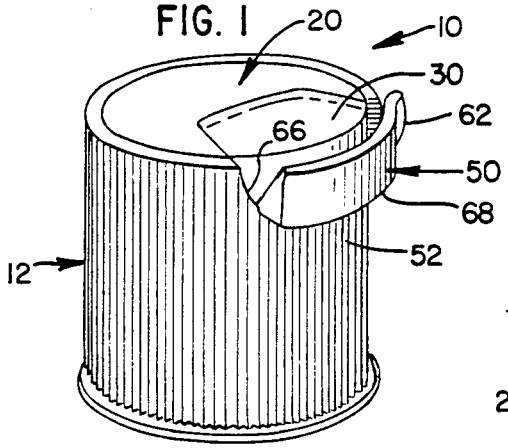
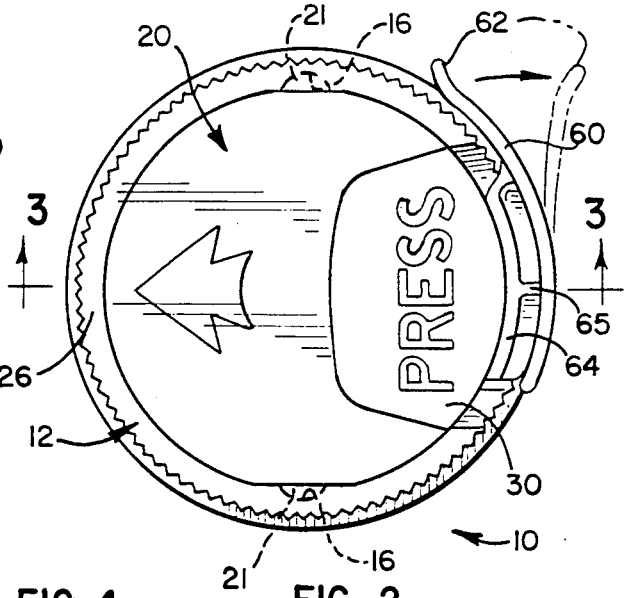
FIG. 2
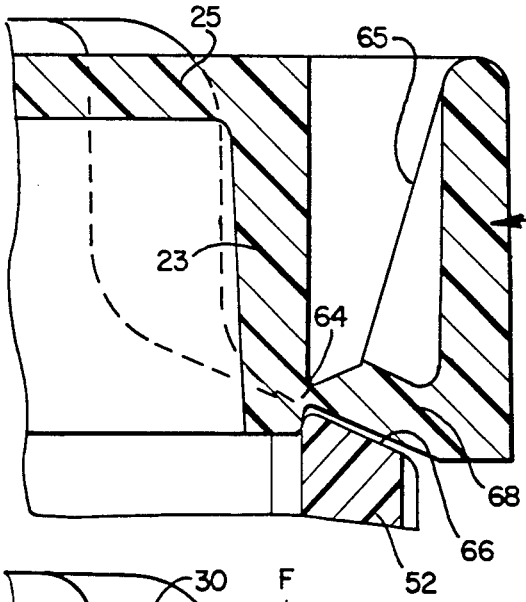
FIG. 4
FIG. 3
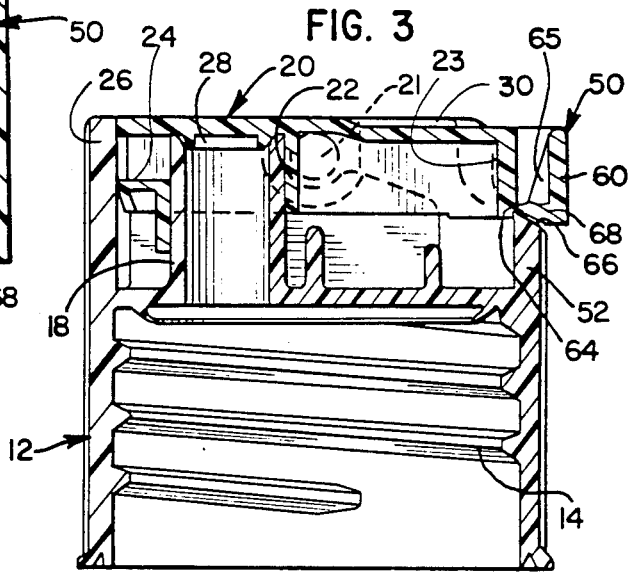
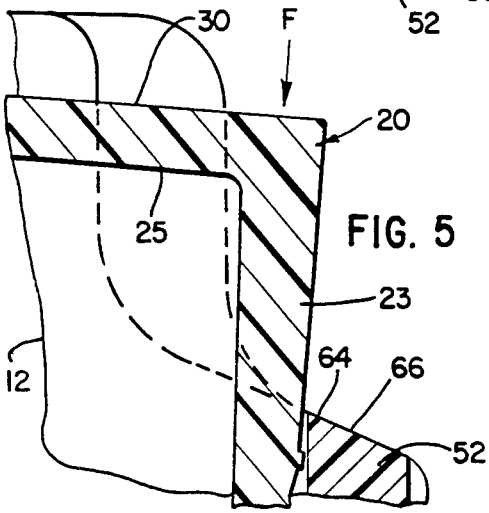
FIG. 5
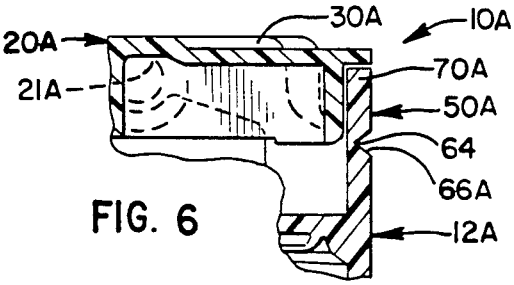
FIG. 6

TOGGLE-ACTING DISPENSING CLOSURE WITH PREMATURE ACTUATION PREVENTION MEANS

This application is a continuation of application Ser. No. 07/345,998 filed on May 2, 1989, now abandoned.

BACKGROUND OF THE INVENTION

A variety of dispensing closures for containers for consumer use are currently available. One such closure which combines highly effective operation with desirable aesthetics is a toggle-acting closure in which the actuator is mounted for pivotal movement between a closed non-dispensing position and an open dispensing position.

One difficulty which is sometimes encountered with such closures is premature actuation of such closures during shipping and handling. Thus the closure may inadvertently or accidently be moved to the open dispensing position, resulting in spillage of the contents and damage of the container as a saleable item. Further such a closure may typically be deliberately opened without itself providing evidence of opening having occurred.

It would therefore be of advantage to provide an improved toggle-acting closure in which the possibility of undesirable leakage would be substantially reduced, and in which premature deliberate actuation would be clearly evidenced, all without changing or affecting the operation of the closure and associated container, and without otherwise significantly changing the structure and the ease of initial actuation of the closure.

SUMMARY OF THE INVENTION

In accordance with the present invention, a toggle-acting dispensing closure is provided which is resistant to premature actuation during shipping and handling prior to purchase, and which provides evidence that access has been gained to the contents of the container. The closure comprises a body and an actuator defining a discharge opening and which is mounted on the body for pivotal movement of the actuator on the body normally in response to a force applied to a finger pad portion of the actuator at a first location on the actuator for movement of the actuator between a closed, non-dispensing position and an open dispensing position.

The closure further includes a removable tear tab means which is joined via severable frangible bridging means with one of the actuator and the body and which is located oppositely from the discharge opening. The tear tab means is positioned adjacent the finger pad portion, and is positioned between the body and the actuator to prevent pivotal movement of the actuator on the body prior to removal of the tear tab means. When the tear tab means is removed by severing the frangible means, the actuator may be pivoted to the open dispensing position in response to the application of a force to the finger pad portion.

In one form of the invention the tear tab is integral with the actuator and the frangible bridging means comprises a web means integral with the actuator adjacent the finger pad portion of the actuator. The web means may be continuous.

Desirably the body defines a fingerwell, and the tear tab means overlies a portion of the fingerwell to prevent pivotal movement of the actuator on the body prior to removal of the tear tab means. The tear tab means portion overlying the fingerwell may desirably be contoured to be complementary to the fingerwell contour.

In another form of the invention the tear tab is integral with the body adjacent the finger pad portion of the actuator, with the actuator preferably overlying the tear tab means to resist pivotal movement of the actuator on the body.

Further objects, features and advantages of the present invention will become apparent from the following description and drawings.

BRIEF DESCRIPTION OF THE DRAWINGS

FIG. 1 is a perspective view of a closure of the present invention in a closed, non-dispensing position;

FIG. 2 is a plan view of the closure of FIG. 1;

FIG. 3 is a sectional view taken substantially along line 3—3 of FIG. 2;

FIG. 4 is an enlarged view of a portion of FIG. 3;

FIG. 5 is a fragmentary enlarged view like FIG. 4, but with the actuator moved to the dispensing position; and FIG. 6 is a fragmentary view of an alternative embodiment of the present invention which is similar in general construction to the closure of FIGS. 1–5.

DETAILED DESCRIPTION

Referring now to the drawings, a toggle-acting dispensing closure 10 of the present invention includes a body 12 defining threads 14 for threaded securance to the neck of a container (not shown). Body 12 may be integrally molded of plastic, such as of polypropylene, or of polyethylene, polyoxymethylene, polystyrene, polybutylene, polymethylpentene, and styrene-acrylonitrile.

An actuator 20 is pivotally mounted on the body 12 via trunnions 21 which are retained in conventional recesses 16 defined by the body. As such, the actuator 20 is toggle-acting, i.e., is pivotally moveable about the trunnions (and recesses) from the closed, non-dispensing position shown by FIGS. 1 to 4, to a conventional open dispensing position illustrated by FIG. 5. Actuator 20 may be integrally molded of plastic, such as of a polyethylene, or of polypropylene, polyoxymethylene, polystyrene, polybutylene, polymethylpentene, and styrene-acrylonitrile.

As best seen in FIG. 3, the body 12 defines a passageway comprising a discharge opening 18 which is in flow communication with the actuator 20. Actuator 20 defines a flow receiving sleeve 22 which, at its forward side, defines a dispensing passage 24. When the actuator 20 is in the non-dispensing position (FIG. 3), the passage 24 sealingly engages a front wall portion 26 of the body 12, preventing discharge through passage 24. Additionally, the discharge opening 18 in the body is sealed within the flow-receiving sleeve 22, as by a sealing post 28.

When the actuator is toggled or pivoted to the position represented by FIG. 5, as by an actuating force F applied to a first location such as against the actuator finger pad 30, the discharge passage 24 will be positioned above the front wall portion 26 and liquid will be free to flow from the container through discharge opening 18, receiving sleeve 22 and discharge passage 24.

As so far described, the closure 10 is the same as closures which have been made for some years by Seaquist Closures, a division of Pittway Corporation.

In accordance with the present invention, a locking tab means is provided to prevent inadvertent or deliberate premature actuation of the actuator 20 and to provide evidence that the actuator has not been actuated, hence that access has not been gained to the contents of the container. To that end a removable locking tear tab 50 is provided as at the rear of the closure 10 and in a position that overlies and extends outwardly from a rear wall portion 52 adjacent the fingerwell zone of the body 12. The locking tear tab is integrally formed with the actuator 20, as during the molding of the actuator 20. Preferably the tab 50 is situated at the rear of the actuator adjacent the actuator finger pad 30 to resist opening when a force, such as force F, is applied to finger pad 30. Thus, as best seen in FIGS. 3 and 4, any effort to pivot the actuator 20 from that non-dispensing position to the dispensing position of FIG. 5 will be impeded, resisted and prevented. Of course actuation, via toggling about trunnions 21 and recesses 16, will be permitted once the tear tab 50 is removed, as is apparent from FIG. 5. Once the tear tab is removed, a customary actuation force F on the first actuation of the actuator will serve to open the closure, without any additional force being required on that first actuation.

In the preferred form shown in the drawings, the locking tear tab 50 comprises a circumferentially oriented segment 60 and an out-turned grippable or finger manipulatable end portion 62. The segment 60 is desirably formed with the actuator 20 via a frangible bridging means such as continuous frangible web 64. For strength and integrity one or more stabilizing struts 65 may be provided. The base 68 of the tab 50 overlies body portion 52 in the zone of the fingerwell 66, and, of course, therefore interferes with pivoting of the actuator from the position of FIG. 4 to that of FIG. 5.

When access to the contents of the container is desired, the tab 50 is gripped as by a user's fingers, as via end portion 62, and is pulled or torn, such as in a radial direction, thereby causing the web 64 to be severed. The tab 50 is thus removed and may be discarded. At that time the actuator 20 may be operated in its normal fashion.

It will be apparent that the closure 10 may serve also as a tamper-evident closure. Under such circumstances it would be desirable also to lock the closure to the container neck finish in one of a variety of conventional ways, so that the closure may not be removed (as it might be with a threaded finish comprising only threads complementary to threads 14). In that way, access to container contents could be gained only via the discharge or dispensing passage 24, and the integrity of the container would be evidenced by the presence of the integrally formed locking tab 50. Of course, the presence or absence of the locking tab 50 may serve also as proof-of-purchase evidence.

Although a specific form of frangible connection has been shown, clearly a series of spaced frangible web segments or bridges, rather than a continuous web 64, may be used. Desirably the frangible means may follow the contour of the fingerwell 66 of the closure body rather than simply being straight and lying straight across a central base portion of the fingerwell. Further, although the frangible means may be, as shown, connected to a vertical back wall 23 of the actuator, the back wall 23 may be omitted and the integral frangible connection be made at the base of the top wall 25 with the necessary interference shown between a tab base 68 and the body rear wall portion 52 being maintained.

It is also contemplated that the tear tab may be formed integrally with the body and may be positioned to underlie a portion of the actuator, as is illustrated by FIG. 6. Thus, in FIG. 6 a closure 10A has a body 12A which is formed integrally with a tear tab 50A which is connected thereto by a frangible means such as a frangible web 64A located along the fingerwell 66A. The upper end 70A of the tear tab 50A underlies a portion of the actuator 20A, preferably in the zone of the finger pad 30A. As such, until tear tab 50A is removed, the actuator 20A will not oscillate or pivot about trunnions 21A between the closed position of FIG. 6 and an open dispensing position comparable to that of FIG. 5.

It will be apparent to those skilled in the art that the principles of this invention may be applied to a wide range of toggle-acting dispensing closures and that a variety of locking tear tab constructions may be developed for use depending upon the specific construction of the toggle-acting dispensing closure to which the principles are applied. As such, the invention is to be construed in that light, and is not intended to be limited to the specific embodiments illustrated.

What is claimed is:

1. A toggle-acting dispensing closure for securance to a container, and which is resistant to premature actuation during shipping and handling prior to purchase and which evidences access to the contents of the container comprising:

a body having a rear wall portion defining a fingerwell that is open upwardly and outwardly at the top of the body, said rear wall portion having an outwardly downwardly inclined upper surface, said fingerwell accommodating an inwardly extending finger during actuation of said closure;

an actuator defining a discharge passage located opposite said fingerwell, said actuator being mounted on said body for pivotal movement of the actuator on the body normally in response to a force applied to a finger pad portion of said actuator at a first location on said actuator adjacent said fingerwell for movement of the actuator between a closed, non-dispensing position and an open dispensing position; and removable tear tab means joined integrally via severable frangible bridging means with said actuator and located oppositely from said discharge passage, said tear tab means being positioned adjacent said finger pad portion and between said body and said actuator to prevent pivotal movement of said actuator on said body prior to removal of said tear tab means, said tear tab means including a peripherally oriented segment extending along said actuator in the closed position adjacent said fingerwell and a tear tab portion which overlies said rear wall portion upper surface, said tear tab portion having a generally complementary downwardly inclined lower surface, whereby when said tear tab means is removed by severing said frangible means, said actuator may be pivoted to said open dispensing position in response to the application of said force to said finger pad portion.

2. A toggle-acting dispensing closure in accordance with claim 1, and wherein said frangible bridging means is a continuous web means integral with said actuator.

3. A toggle-acting dispensing closure in accordance with claim 1, and wherein said tear tab means portion overlying said body rear wall portion is contoured to be complementary to said fingerwell contour.

4. A toggle-acting dispensing closure for securance to a container, and which is resistant to premature actuation during shipping and handling prior to purchase and which evidences access to the contents of the container comprising:

a body having a rear wall portion defining a fingerwell that is open upwardly and outwardly at the top of the body for accommodating an inwardly extending finger during actuation of said closure;

an actuator defining a discharge passage located opposite said fingerwell, said actuator being mounted on said body for pivotal movement of the actuator on the body normally in response to a force applied to a finger pad portion of said actuator at a first location on said actuator adjacent said fingerwell for movement of the actuator between a closed, non-dispensing position and an open dispensing position; and removable tear tab means joined integrally via severable frangible bridging means with said actuator and located oppositely from said discharge passage, said tear tab means being positioned adjacent said finger pad portion and between said body and said actuator to prevent pivotal movement of said actuator on said body prior to removal of said tear tab means, said tear tab means including a circumferentially oriented segment and an out-turned finger grippable end portion, said frangible bridging means comprising a continuous web means integral with said actuator adjacent the top of said body rear wall portion that defines part of said fingerwell, said tear tab means projecting upwardly from and overlying the top of said body rear wall portion that defines part of said fingerwell, said tear tab means being oriented upwardly and being spaced outwardly away from said actuator and body rear wall and located adjacent said actuator in the closed position, and said top of said body rear wall portion and a lower confronting portion of said tear tab means being contoured to be complementary to each other, whereby when said tear tab means is removed by severing said frangible means, said actuator may be pivoted to said open dispensing position in response to the application of said force to said finger pad portion.

5. A toggle-acting dispensing closure for securance to a container, and which is resistant to premature actuation during shipping and handling prior to purchase and which evidences access to the contents of the container comprising:

a body;

an actuator defining a discharge passage and being mounted on said body for pivotal movement of the actuator on the body normally in response to a force applied to a finger pad portion of said actuator at a first location on said actuator for movement of the actuator between a closed, non-dispensing position and an open dispensing position; and upwardly projecting removable tear tab means integrally joined via severable frangible bridging means only with said body, and located oppositely from said discharge passage adjacent said finger pad portion of said actuator, said tear tab means including a circumferentially oriented segment and an out-turned finger grippable end portion, said actuator overlying said tear tab means to prevent pivotal movement of said actuator on said body prior to removal of said tear tab means, whereby when said tear tab means is removed by severing said frangible means, said actuator may be pivoted to said open dispensing position in response to the application of said force to said finger pad portion.

6. A toggle-acting dispensing closure in accordance with claim 5, wherein said frangible bridge means is a continuous web means integral with said body.

7. A toggle-acting dispensing closure for securance to a container, and which is resistant to premature actuation during shipping and handling prior to purchase and which evidences access to the contents of the container comprising:

a body having a rear wall portion defining a fingerwell that is open upwardly and outwardly at the top of the body for accommodating an inwardly extending finger during actuation of said closure;

an actuator defining a discharge passage located opposite said fingerwell, said actuator being mounted on said body for pivotal movement of the actuator on the body normally in response to a force applied to a finger pad portion of said actuator at a first location on said actuator adjacent said fingerwell for movement of the actuator between a closed, non-dispensing position and an open dispensing position; and removable tear tab means joined via severable frangible bridging means with said actuator and located oppositely from said discharge passage, said tear tab means being positioned adjacent said finger pad portion and between said body and said actuator to prevent pivotal movement of said actuator on said body prior to removal of said tear tab means, said frangible bridging means comprising a continuous web means integral with said actuator adjacent the top of said body rear wall portion that defines part of said fingerwell, said tear tab means overlying the top of said body rear wall portion that defines part of said fingerwell, said tear tab means being oriented upwardly and being spaced outwardly away from said actuator and body rear wall and located adjacent said actuator in the closed position, and said top of said body rear wall portion and a lower confronting portion of said tear tab means being contoured to be complementary to each other, the top of said body rear wall portion being curved and inclined downwardly and the lower confronting portion of said tear tab means being complementary thereto, whereby when said tear tab means is removed by severing said frangible means, said actuator may be pivoted to said open dispensing position in response to the application of said force to said finger pad portion.

* * * * *